US008919817B2

(12) United States Patent
Ozaki et al.

(10) Patent No.: US 8,919,817 B2
(45) Date of Patent: Dec. 30, 2014

(54) BULLDOZER

(71) Applicant: Komatsu Ltd., Tokyo (JP)

(72) Inventors: Taira Ozaki, Ikoma (JP); Hiroshi Nakagami, Hirakata (JP); Shuta Matsumura, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/126,480

(22) PCT Filed: Feb. 22, 2013

(86) PCT No.: PCT/JP2013/054525

§ 371 (c)(1),
(2), (4) Date: Dec. 16, 2013

(87) PCT Pub. No.: WO2014/128919

PCT Pub. Date: Aug. 28, 2014

(65) Prior Publication Data

US 2014/0239625 A1 Aug. 28, 2014

(51) Int. Cl.

| | |
|---|---|
| ***B60K 15/067*** | (2006.01) |
| ***E02F 9/08*** | (2006.01) |
| ***E02F 9/16*** | (2006.01) |

(52) U.S. Cl.

CPC ..... *E02F 9/0883* (2013.01); *E02F 9/16* (2013.01)

USPC ..... 280/834

(58) Field of Classification Search

USPC ..... 280/834; 180/89.12

See application file for complete search history.

(56) References Cited

U.S. PATENT DOCUMENTS

| | | | | |
|---|---|---|---|---|
| 7,374,208 | B2 * | 5/2008 | Yamamoto et al. | 280/834 |
| 7,836,967 | B2 * | 11/2010 | Daniel et al. | 172/781 |
| 2005/0051373 | A1 * | 3/2005 | Bernhardt et al. | 180/89.12 |
| 2010/0283232 | A1 * | 11/2010 | Ogawa et al. | 280/834 |
| 2012/0247846 | A1 * | 10/2012 | Ichikawa | 180/65.21 |
| 2013/0069357 | A1 * | 3/2013 | Green | 280/834 |
| 2014/0014426 | A1 * | 1/2014 | Lauper et al. | 180/68.1 |

FOREIGN PATENT DOCUMENTS

| | | | |
|---|---|---|---|
| JP | 2007-247337 | A | 9/2007 |
| JP | 4598195 | B2 | 10/2010 |
| WO | 2006/098078 | A1 | 9/2006 |

OTHER PUBLICATIONS

International Search Report for PCT/JP2013/054525, issued on May 7, 2013.

* cited by examiner

*Primary Examiner* — Joseph M Rocca
*Assistant Examiner* — Gabriela C Craciun
(74) *Attorney, Agent, or Firm* — Global IP Counselors, LLP

(57) ABSTRACT

A bulldozer includes a cab, a fuel tank arranged to a rear of the cab, and first and second engaging members. The cab includes a driver seat and an air-conditioning cooling module projecting rearward from an upper end portion of the cab. The first and second engaging members are provided on the fuel tank, with each having an engaging part to engage onto a suspension member. The engaging part of the first engaging member is positioned on a first lateral side of a first straight line connecting a first lateral side end of the air-conditioning cooling module and a first lateral side end of the fuel tank. The engaging part of the second engaging member is positioned on a second lateral side of a second straight line connecting a second lateral side end of the air-conditioning cooling module, and a second lateral side end of the fuel tank.

18 Claims, 6 Drawing Sheets

BULLDOZER

CROSS-REFERENCE TO RELATED APPLICATIONS

This application is a U.S. National stage application of International Application No. PCT/JP2013/054525, filed on Feb. 22, 2013.

BACKGROUND

1. Field of the Invention

The present invention relates to a bulldozer.

2. Background Information

A bulldozer has a fuel tank rearward of the cab (see for example, Japanese Unexamined Patent Application Publication No. 2007-247337). Below the fuel tank are arranged components such as hydraulic piping or the like. Accordingly, when for example an oil leakage occurs and it becomes necessary to repair the hydraulic piping the fuel tank must be removed.

The fuel tank is removed from the vehicle body frame by being hoisted by a crane or the like. Basically, engaging parts are installed at each end of the fuel tank in the vehicle width direction. Shackles at the lower ends of {each of two wire ropes are attached to these engaging parts. The fuel tank is removed from the vehicle body frame as the wire ropes are caught by the crane hook and the fuel tank is hoisted.

The hanging angle that is the angle formed by the two wire ropes when the fuel tank is hoisted, is set within the optimum range that enables the fuel tank to be hoisted stably. It is also suitable to have a single wire rope. In this case, the center of the wire rope is caught by the hook and the wire rope has shackles at both ends. In this case, the flexion angle of the wire rope centered on the hook is the hanging angle.

In recent years, it has become desirable to mount on a bulldozer, an exhaust gas treatment device for treating exhaust gas. Here, it is conceivable to install an exhaust gas treatment device in the engine room of the bulldozer. Because space within the engine room is limited, when installing an exhaust gas treatment device in the engine room it is necessary to install, for example an air-conditioning cooling module (such as an air conditioning condenser or the like), in a place outside of the engine room. In this case, it is conceivable that the air-conditioning cooling module be arranged so as to project rearward from the upper end portion of the rear face of the cab.

As described above, there are cases in which an air-conditioning cooling module is arranged so as to project rearward from the rear face upper end portion of the cab. With this kind of air-conditioning cooling module however, when hoisting the fuel tank, if the wire rope is not lengthened, reducing the hanging angle of the wire rope below the optimum range, interference occurs between the wire rope and the air-conditioning cooling module.

An object of the present invention is that while maintaining the hanging angle of a wire rope or the like for hoisting a fuel tank within the optimum range, interference between the air-conditioning cooling module projecting rearward from the cab and the wire rope or the like, is avoided.

(1) A bulldozer according to an aspect of the present invention comprises a cab, a fuel tank, a first engaging member and a second engaging member. The cab has a driver's seat installed therein, and an air-conditioning cooling module projecting rearward from the upper end portion of the cab. The fuel tank is arranged to the rear of the cab. The first engaging member and the second engaging member, each having an engaging part capable of engaging onto a suspension member, are provided on the fuel tank. The engaging part of the first engaging member is, in the rear view, positioned on a first lateral side in the vehicle width direction of a first straight line connecting the first lateral side end at the upper end of the air-conditioning cooling module and the first lateral side end at the upper end of the fuel tank. The engaging part of the second engaging member, is, in the rear view, positioned on a second lateral side in the vehicle width direction of a second straight line connecting the second lateral side end at the upper end of the air-conditioning cooling module and the second lateral side end at the upper end of the fuel tank.

When hoisting the fuel tank in the above described bulldozer, the suspension member (for example a shackle or the like) at each lower end of one or two wire ropes hanging from for example, the hook of a crane, is caused to engage the engaging parts of the first and the second engaging members. Here, in the rear view, the engaging part of the first engaging member is positioned on the first lateral side of the first straight line, and the engaging part of the second engaging member is positioned on the second lateral side of the second straight line. For this reason, when hoisting the fuel tank, with the angle at which the wire rope hangs (the hanging angle of the wire rope) being maintained within the optimum range, the distance between wire ropes at a predetermined height (especially at the upper end of the cab) can be increased. Resultantly, interference between the wire rope and the air-conditioning cooling module projecting to the rear from the upper end part of the rear face of the cab can be prevented. Further, as the hanging angle of the wire rope can be maintained within the optimum range, the fuel tank can be stably hoisted.

(2) It is preferable that the center of the fuel tank in the vehicle width direction is positioned on the first lateral side in comparison to the center of the cab in the vehicle width direction, and that the engaging part of the second engaging member is, in the rear view, positioned on the second lateral side of the fuel tank.

According to this configuration, as the fuel tank is arranged biased toward the first lateral side, accommodating space can be provided to the second lateral side of the fuel tank. For this reason, a battery for example, can be accommodated in this space. Further, by positioning the fuel tank biased toward the first lateral side, the second lateral side end of the fuel tank is biased toward the center in the vehicle width direction. For this reason, when hoisting the fuel tank, a wire rope extending from the second lateral side end portion of the fuel tank could readily interfere with the air-conditioning cooling module. However, according to the above described configuration, as the engaging part of the second engaging member is, in the rear view, positioned to the second lateral side, the wire rope extending from the engaging part is shifted toward the second lateral side, enabling interference with the air-conditioning cooling module to be prevented.

(3) It is preferable that the first and second engaging members be of planar form, each member having respectively, a first end portion and a second end portion. The first end portion is secured to the fuel tank, and the second end portion has the engaging part. In this configuration, the engaging part can be positioned more to the outside enabling interference between the air-conditioning cooling module and the wire rope to be prevented.

(4) It is preferable for the fuel tank, in the backward direction of the vehicle, to be tilted diagonally downward, and for the first and second engaging members to be positioned forward of center in the forward-backward direction of the fuel tank.

In this configuration, as the fuel tank is tilted diagonally downward, a favorable field of vision from the cab in the rearward direction can be realized. Note that the fuel tank, being of the form as described above, the gravitational center thereof is positioned forward of center in the forward-backward direction. In relation to this, as the first and second engaging members are disposed forward in the same manner, the fuel tank comes to be hoisted above the position of the gravitational center in the forward-backward direction. This enables the fuel tank to be stably hoisted. Further, although the engaging parts of the first and second engaging members being so positioned forward means interference between the wire rope and the air-conditioning cooling module projecting rearward from the cab becomes easier, interference can be prevented because, as described above, the distance between each wire rope at a predetermined height is increased.

(5) It is preferable that the first and second engaging members are detachably installed on the fuel tank. As the first and second engaging members project outward from the fuel tank there is concern that when the bulldozer is being used, these may impede the work or obstruct the field of vision. In response to this, installing the first and second engaging members on the fuel tank such that these members can be detached enables these members to be detached from the fuel tank when not needed thereby enabling the above described problems to be solved.

According to the present invention, {a bulldozer is provided in which} the angle at which a wire rope or the like hangs in order to hoist up a fuel tank being maintained within the optimum range, interference between an air conditioning cooling module projecting rearward from the cab and the wire rope or the like can be avoided.

DETAILED DESCRIPTION OF THE EMBODIMENTS

Figure 1:
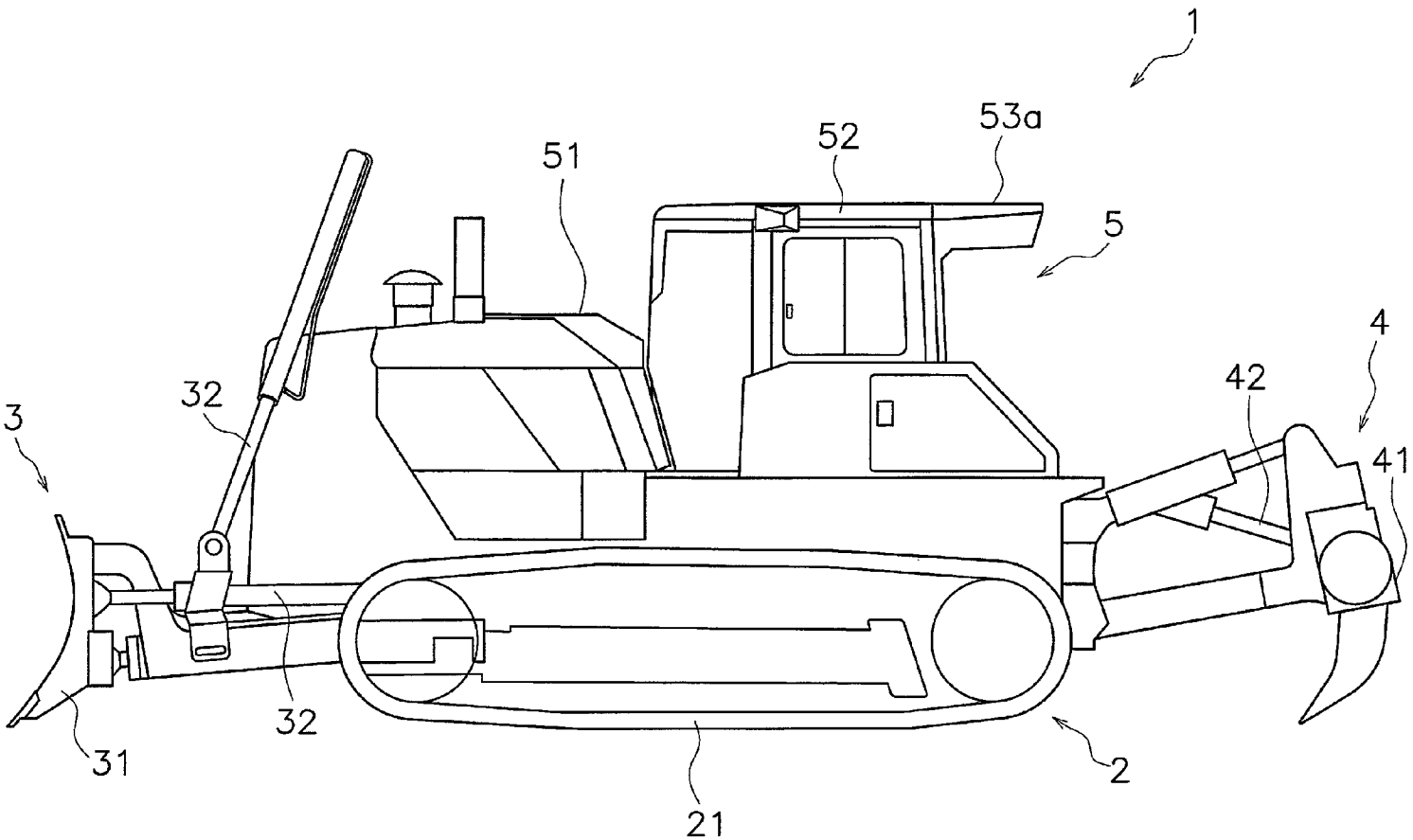
FIG. 1 is a side view of a bulldozer.
Figure 2:
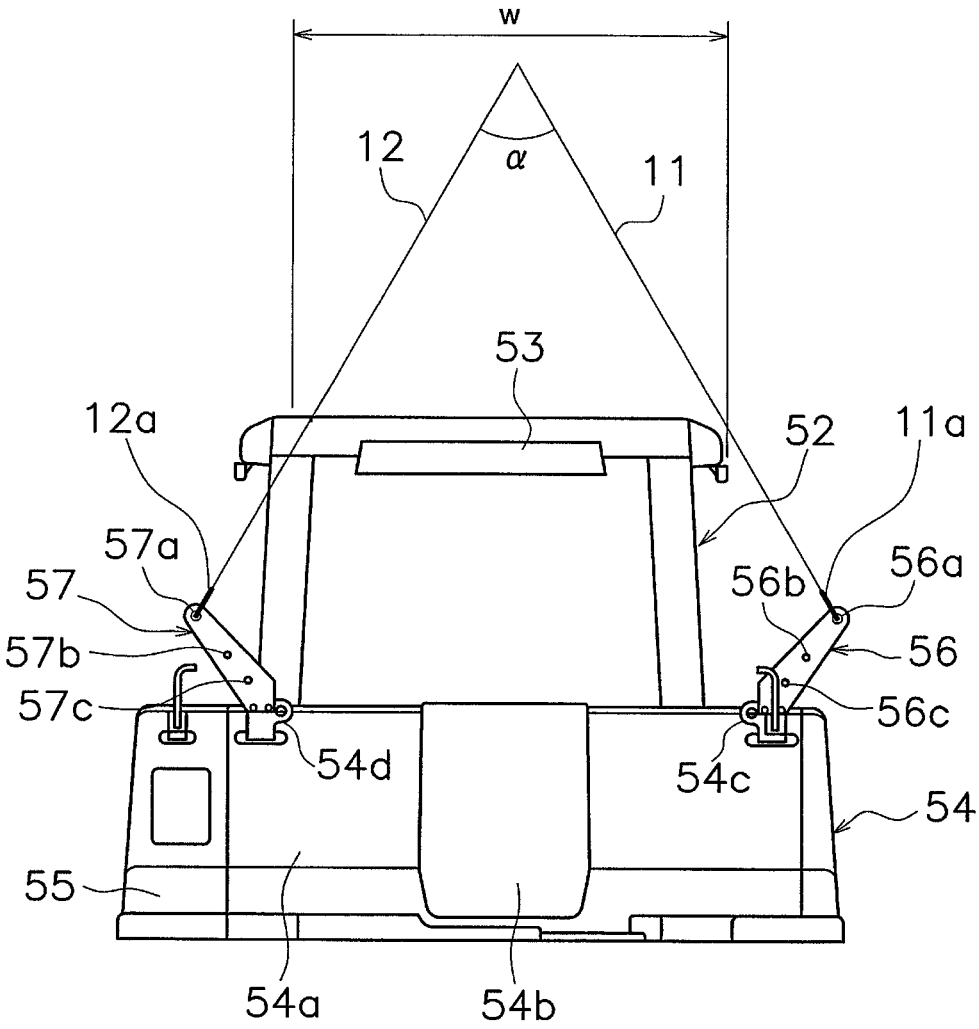
FIG. 2 is a partial rear view of a bulldozer in the condition in which the condenser cover is removed.
Figure 3:
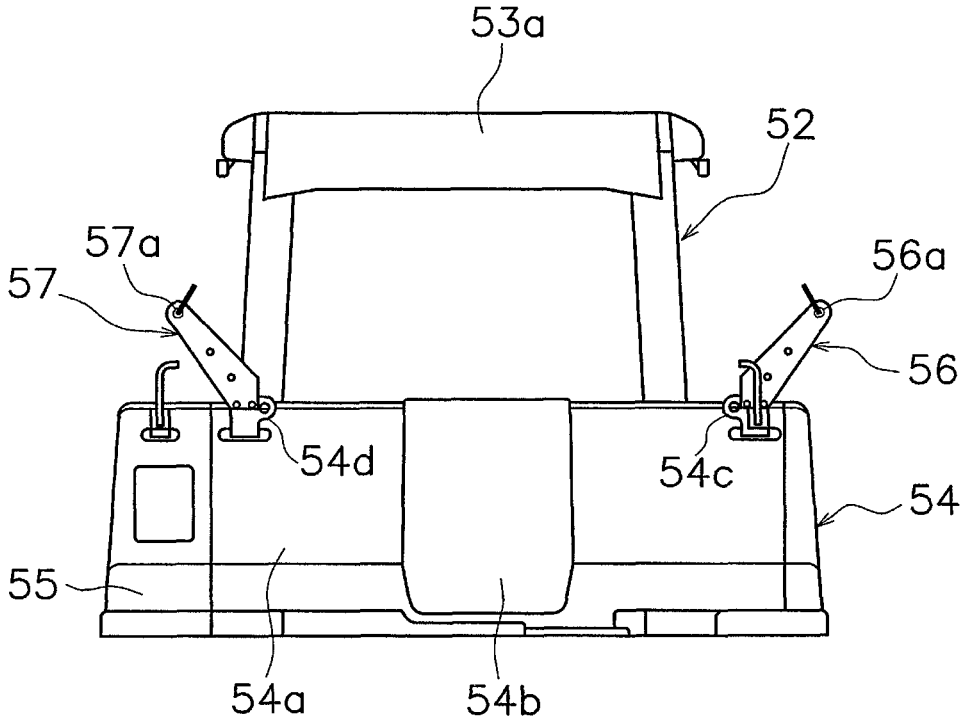
FIG. 3 is a partial rear view of a bulldozer in the condition in which the condenser cover is removed.
Figure 4:
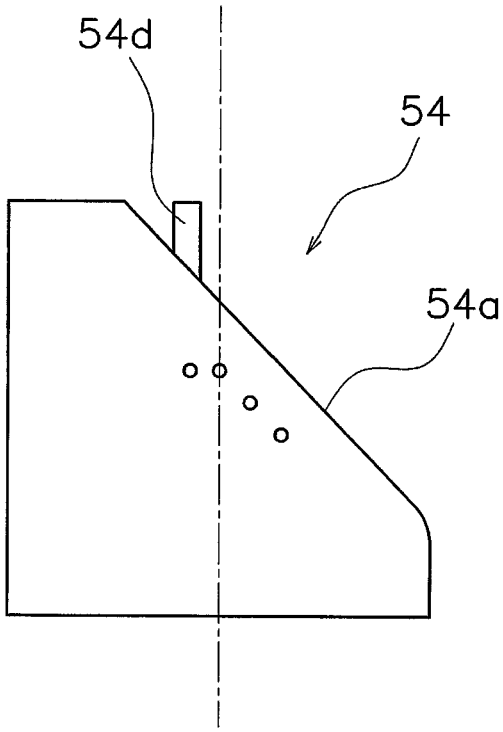
FIG. 4 is a side view of the fuel tank.
Figure 5:
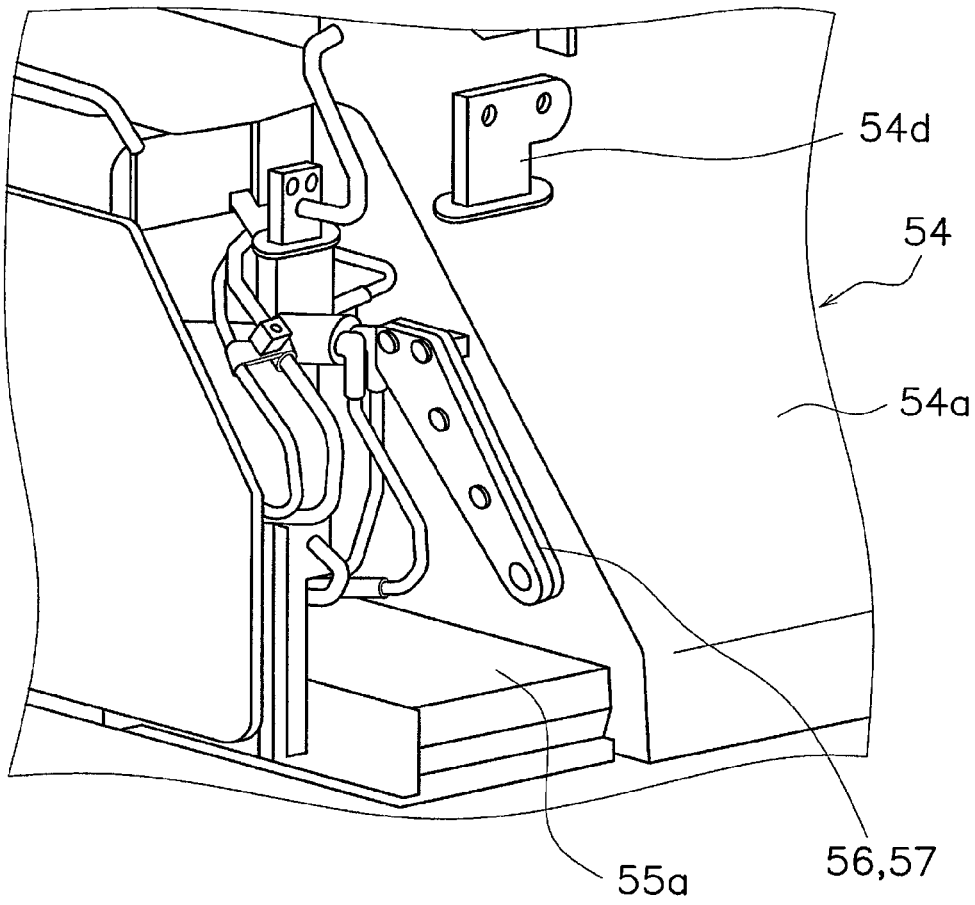
FIG. 5 is a partial perspective view in the condition in which the battery cover is removed.

A bulldozer according to an embodiment of the present invention will now be described with reference to the drawings. FIG. 1 is a side view of a bulldozer, FIG. 2 is a partial rear view of a bulldozer in the condition in which the condenser cover is removed, FIG. 3 is a partial rear view of a bulldozer in the condition in which the condenser cover is removed, FIG. 4 is a side view of the fuel tank, and FIG. 5 is a partial perspective view in the condition in which the battery cover is removed. Note that in the following explanation, "front" and "rear" mean the front and the rear of the vehicle body 5. That is to say, the left side in FIG. 1 is "front", the right side in FIG. 1 is "rear". Further, "left", "right", "up", and "down" indicate the standard directions of the condition viewed when looking forward from the driver seat, while "widthwise direction of the vehicle" and "leftward-rightward direction" have the same meaning.

As shown in FIG. 1, a bulldozer 1 includes a traveling device 2, a first working machine 3, a second working machine 4 and a vehicle body 5.

The traveling device 2, a device that causes the vehicle to travel, is attached to the vehicle body 5. A traveling device 2 has a pair of crawler tracks 21. The bulldozer 1 travels as it is driven by each of the crawler tracks 21.

The first working machine 3 is disposed to the front of the vehicle body 5. The first working machine 3 has a blade 31, and a plurality of hydraulic cylinders 32. The blade 31 is provided such that it is able to swing in the upward-downward direction. The hydraulic cylinders 32 change the posture of the blade 31.

The second working machine 4 is disposed to the rear of the vehicle body 5. The second working machine 4 has a ripper 41, and a plurality of hydraulic cylinders 42. The ripper 41 is provided such that it can be caused to move in the upward-downward direction. The hydraulic cylinders 42 cause the ripper 41 to move.

The vehicle body 5 has a vehicle frame (not shown in the drawings), an engine cover 51, a cab 52, an air conditioning condenser (an example of an air-conditioning cooling module) 53 (referring to FIG. 2) and a fuel tank 54 (referring to FIG. 2).

The engine cover 51, the cab 52, and the fuel tank 54 are supported by the vehicle frame. Inside the engine room that is a space covered by the engine cover 51, are arranged an engine, and an exhaust gas treatment device (for example a diesel particulate filter, and a nitrogen oxide reducing catalytic device) and the like.

The cab 52 has a driver seat disposed therein. As shown in FIG. 2, the air conditioning condenser 53 is attached at the upper end portion of the rear face of the cab 52, projecting rearward from the cab 52. The air conditioning condenser 53 has a condenser body and an electric fan that blows toward the condenser body. As shown in FIG. 3, the air conditioning condenser 53 is covered by a condenser cover 53*a* except for times when the fuel tank 54 is removed. The condenser cover 53*a* is attached to the cab 52 by a fastening member such as a bolt or the like, so as to be able to be removed from the cab 52.

As shown in FIG. 2, the fuel tank 54 is arranged to the rear of the cab 52. Further, as the air conditioning condenser 53 projects rearward from the rear face upper end portion of the cab 52, the fuel tank 54 is positioned below the air conditioning condenser 53.

As shown in FIG. 4, the fuel tank 54 has a tapered face 54*a*, with, viewed from the side, the height of the tapered face 54*a* decreasing toward the rear. That is to say, the fuel tank 54 inclines downward in the rearward direction. For this reason, the gravitational center of the fuel tank 54 is positioned forward of center in the forward-backward direction. As shown in FIG. 2, the fuel tank 54 has, in substantially the center portion in the leftward-rightward direction, a concavity 54*b* extending in the upward downward direction, thereby providing a favorable field of vision from the cab 52 in the rearward direction and improved operability of the second working machine 4 behind the vehicle body 5.

Further, the fuel tank 54 has a first mounting part 54*c* and a second mounting part 54*d* on the tapered face 54*a*. The first mounting part 54*c* is formed at the upper right portion on the tapered face 54*a*, and the second mounting part 54*d* is formed at the upper left portion on the tapered face 54*a*. The first and second mounting parts 54*c* and 54*d* are, in the side view, formed so as to be positioned above the gravitational center of the fuel tank 54, therefore being formed forward of center in the forward-backward direction of the fuel tank 54 (referring to FIG. 4). The first and second mounting parts 54*c* and 54*d* each have two through holes (not shown in the drawings).

To the right of the fuel tank 54 a battery cover 55 is provided. A battery 55*a* is arranged in the space covered by the battery cover 55 (referring to FIG. 5). In this way, as the battery 55*a* is disposed to the left of the fuel tank 54, the center of the fuel tank 54 in the vehicle width direction is positioned further to the right side than the center of the cab 52 in the vehicle width direction.

The bulldozer 1 further includes a first engaging member 56 and a second engaging member 57 for hoisting the fuel tank 54. The first and second engaging members 56 and 57 formed of for example, steel plate, are substantially rectangular plate-shaped members, each having a first end portion and a second end portion.

The first end portions that are the lower end portions of the first and second engaging members 56 and 57 respectively, each have two through holes (not shown in the drawing) formed therein, in the same manner as the first and second mounting parts 54*c* and 54*d* as described above. The second end portions that are the upper end portions of the first and second engaging members 56 and 57 respectively, have engaging holes (an example of an engaging part) 56*a* and 57*a* respectively, formed therein. The engaging holes 56*a* and 57*a* are able to engage with a linear member. Basically, linear members are the first and second wire ropes 11 and 12 each having at the end as a suspension member, U-shaped connecting fittings (shackles) 11*a* and 12*a* respectively. The shackles 11*a* and 12*a*, respectively of the wire ropes 11 and 12, engage with the engaging holes 56*a* and 57*a* respectively. Further, in the first engaging member 56 are formed the through holes 56*b* and 56*c*, in the second engaging member 57 are formed the through holes 57*b* and 57*c*, these through holes being formed at predetermined intervals along the lengthwise direction.

The first engaging member 56 is attached using a fastening member such as a bolt or the like, to the first mounting part 54*c* formed on the tapered face 54*a* of the fuel tank 54. Specifically, a bolt passes through a through hole formed in the first end portion of the first engaging member 56 and a through hole formed in the first mounting part 54*c*, with a nut being screwed onto the end of the bolt. In this way, the first engaging member 56 and the first mounting part 54*c* are inserted in the head portion of the bolt and the nut, and the first engaging member 56 is fastened to the first mounting part 54*c*. In the same manner also, the second engaging member 57 is attached using a fastening member such as a nut and bolt or the like to the second mounting part 54*d*.

Figure 6:
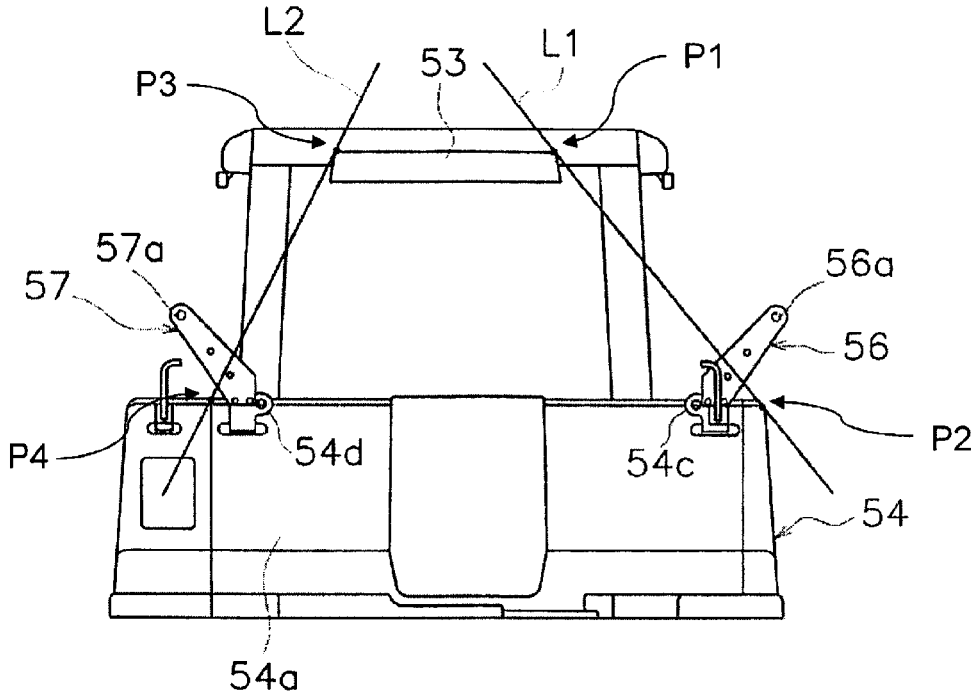
FIG. 6 is a partial rear view of the bulldozer in the condition in which the condenser cover is removed.

FIG. 6 is a partial rear view of the bulldozer in the condition in which the condenser cover is removed. As shown in FIG. 6, the first engaging member 56 is secured to the first mounting part 54*c* so as to extend in the upward and rightward direction from the fuel tank 54. In the condition in which the first engaging member 56 is secured to the first mounting part 54*c*, the engaging hole 56*a* of the first engaging member 56 is, in the rearview, positioned further to the right side (an example of the first lateral side) than a first straight-line L1. Specifically, the engaging hole 56*a* of the first engaging member 56 is, in the rear view, positioned above and to the right of the fuel tank 54. Note that the first straight-line L1 is, in the rear view, a line that joins a first point P1 on the right end (an example of the first lateral side end) at the upper end of the air conditioning condenser 53 and a second point P2 on the right end (an example of the first lateral side end) at the upper end of the fuel tank 54. That is to say, the first straight-line L1 is, in the rear view, a straight-line joining the right upper end of the air conditioning condenser 53 with the right upper end of the fuel tank 54.

The second engaging member 57 is secured to the second mounting part 54*d* so as to extend in the upward and leftward direction from the fuel tank 54. In the condition in which the second engaging member 57 is secured to the second mounting part 54*d*, the engaging hole 57*a* of the second engaging member 57 is, in the rearview, positioned further to the left side (an example of the second lateral side) than a second straight-line L2. Specifically, the engaging hole 57*a* of the second engaging member 57 is, in the rear view, positioned above and to the left of the fuel tank 54. Note that the second straight-line L2 is, in the rear view, a line that joins a third point P3 on the left end (an example of the second lateral side) at the upper end of the air conditioning condenser 53 and a fourth point P4 on the left end (an example of the second lateral side) at the upper end of the fuel tank 54. That is to say, the second straight-line L2 is, in the rear view, a straight-line joining the left upper end of the air conditioning condenser 53 with the left upper end of the fuel tank 54.

As shown in FIG. 5, the first and second engaging members 56 and 57 when not being used, are detached from the first and second mounting parts 54*c* and 54*d* of the fuel tank 54 and are housed in the space covered by the battery cover 55. Specifically, the first and second engaging members 56 and 57 being arranged mutually co-incident such that their respective through holes match, the bolt inserts through each through hole. By screwing the end portion of the bolts into screw holes formed in the left side face of the fuel tank 54, the first and second engaging members 56 and 57 are fastened to the left side face of the fuel tank 54. Note that the bolts used for fastening the first and second engaging members 56 and 57 to the left side face of the fuel tank 54 are used in order to fasten the first and second engaging members 56 and 57 to the first and second mounting parts 54*c* and 54*d* of the fuel tank 54.

(Method of Hoisting the Fuel Tank)

The method for hoisting the fuel tank 54 will now be described with reference to FIG. 2. Firstly, bolts and nuts are used to fasten the first end portion of the first engaging member 56 to the first mounting part 54*c* of the fuel tank 54. In the same manner, the first end portion of the second engaging member 57 is fastened to the second mounting part 54*d* of the fuel tank 54. The condenser cover 53*a* is detached from the cab 52.

Next, the first and second wire ropes are hung to the hook of a crane. The first and second wire ropes 11 and 12 have at their respective lower ends the shackles 11*a* and 12*a*. The shackle 11*a* of the first wire rope 11 is caused to engage the engaging hole 56*a* of the first engaging member 56. In this way, the first wire rope 11 and the first engaging member 56 are linked. Further, the shackle 12*a* of the second wire rope 12 is caused to engage the engaging hole 57*a* of the second engaging member 57. In this way the second wire rope 12 and the second engaging member 57 are linked.

The crane is then operated such that the fuel tank 54 is slightly raised up moreover caused to move rearward, so as not to contact the air conditioning condenser 53. As the fuel tank 54 moves further rearward from the rear end of the air conditioning condenser 53, the fuel tank 54 is raised further. In this way, the fuel tank 54 is hoisted and detached from the vehicle frame enabling replacement and repairs to be performed on piping and the like arranged underneath the fuel tank 54. Note that the hanging angle $\alpha$ of the first and second wire ropes 11 and 12 when stretched should preferably be approximately 60°. Setting the hanging angle $\alpha$ within this range enables the fuel tank 54 to be stably hoisted.

Characteristics

In the rear view, the engaging hole 56*a* of the first engaging member 56 is positioned further to the right side than the first straight-line L1, and the engaging hole 57*a* of the second engaging member 57 is positioned further to the left side than the second straight-line L2. For this reason, when the fuel tank 54 is hoisted by the first and second wire ropes 11 and 12, the hanging angle of those wire ropes being maintained within the optimum range, the distance w between the wire rope 11 and the wire rope 12 at a predetermined height can be increased. As a result, even with the air conditioning condenser 53 projecting rearward from the cab 52, interference of the first and second wire ropes 11 and 12 with the air conditioning condenser 53 can be prevented.

(2) As the fuel tank 54 is positioned biased to the right side, space to the left side of the fuel tank 54 can be formed for accommodating the battery 55*a*. Further, bringing the fuel tank 54 toward the right side brings the left end of the fuel tank 54 biased to the center in the vehicle width direction. For this reason, the air conditioning condenser 53 projecting rearward from the cab 52 could readily interfere with the second wire rope 12. However, the engaging hole 57*a* of the second engaging member 57 being, in the rear view, positioned to the left side of the fuel tank 54, the second wire rope 12 is shifted to the left side, enabling such interference with the air conditioning condenser 53 to be prevented.

(3) The fuel tank 54 inclines downward in the rearward direction. That is to say, as the fuel tank 54 has a tapered form, the height of the fuel tank 54 decreasing toward the rear, a favorable field of vision from the cab 52 in the rearward direction can be realized. Note that as the fuel tank 54 is of the above described form, the gravitational center of the fuel tank 54 is positioned forward of center in the forward-backward direction. In relation to this, as the first and second engaging members 56 and 57 are disposed forward in the same manner, the fuel tank is hoisted proximate to the gravitational center in the forward-backward direction. This enables the fuel tank to be stably hoisted. Further, although with the first and second engaging parts 56*a* and 57*a* of the first and second engaging members 56 and 57 being so positioned forward, interference of the first and second wire ropes 11 and 12 with the air conditioning condenser 53 projecting rearward from the cab 52 could readily occur, such interference does not occur because, as described above, the distance w between the first wire rope 11 and the second wire rope 12 at a predetermined height is increased.

(4) As the first and second engaging members 56 and 57 project from the fuel tank 54, there is a problem of concern that when the bulldozer is being used the field of vision may be obstructed. In relation to this, this configuration enabling the first and second engaging members 56 and 57 to be attached to or detached from the fuel tank 54, detaching these members from the fuel tank 54 when not needed enables the problem to be solved. Further, as the first and second engaging members 56 and 57 project from the fuel tank 54 upward and toward the side, there is a problem of concern about obstruction created by these members when the bulldozer 1 is being used. In relation to this, this configuration enabling the first and second engaging members 56 and 57 to be attached to or detached from the fuel tank 54, these members can be detached from the fuel tank 54 when not needed, enabling this problem to be solved.

(5) The air conditioning condenser 53, that is generally arranged in the engine room, being arranged to the rear of the cab 52, enables space to be formed in the engine room. For this reason, an exhaust gas treatment device (for example a diesel particulate filter, and a nitrogen oxide reducing catalytic device) can be accommodated in the engine room.

ALTERNATIVE EMBODIMENTS

Although the invention has been described above by reference to an embodiment thereof, the invention is not limited to the embodiment described above. It is therefore understood that numerous modifications and variations can be devised without departing from the scope of the invention.

Alternative Embodiment 1

In the above-described embodiment, in order to avoid interference between the condenser cover 53*a* and the second wire rope 12, the condenser cover 53*a* is detached. Here, increasing the length of the second engaging member 57 such that the engaging hole 57*a* of the second engaging member 57 is positioned further removed from the fuel tank 54 enables interference between the condenser cover 53*a* and the second wire rope 12 to be avoided. Resultantly, an operation to hoist the fuel tank 54 can be performed without detaching the condenser cover 53*a*.

Alternative Embodiment 2

The engaging hole 56*a* of the first engaging member 56 only needs to be positioned further to the right side than the first straight-line L1. For example, the first engaging member 56 may extend upward from the first mounting part 54*c*, the engaging hole 56*a* being positioned above the fuel tank 54. The first engaging member 56 may extend to the right from the first mounting part 54*c*, the engaging hole 56*a* being positioned to the right side of the fuel tank 54.

Alternative Embodiment 3

The engaging hole 57*a* of the second engaging member 57 only needs to be positioned further to the left side than the second straight-line L2. For example, the second engaging member 57 may extend upward from the second mounting part 54*c*, the engaging hole 57*a* being positioned above the fuel tank 54. The second engaging member 57 may extend to the left side from the second mounting part 54*c*, the engaging hole 57*a* being positioned to the left side of the fuel tank 54.

Alternative Embodiment 4

The first and second engaging members 56 and 57 may be undetectably fastened to the fuel tank 54. For example, the first and second engaging members 56 and 57 may be welded to the fuel tank 54. Here, the first and second engaging members 56 and 57 may be welded to the first and second mounting parts 54*c* and 54*d* respectively. The first and second mounting parts 54*c* and 54*d* may be omitted, and the first and second engaging members 56 and 57 may be welded to the tapered face 54*a* for example.

Alternative Embodiment 5

In the above-described embodiment, the fuel tank 54 is offset to the right side however the fuel tank 54 may be offset to the left side such that the battery cover 55 is disposed to the right of the fuel tank 54. Further, the battery cover 55 to the left of the fuel tank 54 may be omitted, and the fuel tank 54 may be of the same width as the vehicle width of the vehicle body 5. Here, the center of the fuel tank 54 in the vehicle width direction is substantially the same as that of the cab 52.

Alternative Embodiment 6

In the above described embodiment, the fuel tank 54 is hoisted by the first and second wire ropes 11 and 12, however the present invention is not limited to this configuration and the fuel tank 54 may be hoisted by another linear member. Further, the suspension member that engages the engaging holes 56*a* and 57*a* is not limited to the shackles 11*a* and 12*a* and may be another kind of fitting.

The invention claimed is:

1. A bulldozer comprising:

a cab including a driver seat installed therein, and an air-conditioning cooling module projecting rearward from an upper end portion of the cab;

a fuel tank arranged to a rearward of the cab; and a first engaging member and a second engaging member provided on the fuel tank, each of the engaging members member having an engaging part configured and arranged to engage onto a suspension member for hoisting the fuel tank;

the engaging part of the first engaging member being, in a rear view, positioned toward a first lateral side of the bulldozer in a vehicle width direction with respect to a first straight line that is defined by a first point and a second point, the first point being disposed on an upper edge of the air conditioning module at a position farthest toward the connecting a first lateral side of the bulldozer, at an upper end of the air conditioning cooling module and the second point being disposed on an upper edge of the fuel tank at a position farthest toward the first lateral side end at an upper end of the fuel tank of the bulldozer, the engaging part of the second engaging member being, in the rear view, positioned toward a second lateral side of the bulldozer in the vehicle width direction with respect to a second straight line that is defined by a third point and a fourth point, the third point being disposed on the upper edge of the air conditioning module at a position farthest toward the second lateral side of the bulldozer at the upper end & the air conditioning cooling module, and the fourth point being disposed on the upper edge of the fuel tank at a position farthest toward the second lateral side end at the upper end of the fuel tank of the bulldozer wherein respective ends of the first and second engaging members are located laterally outwards of the respective first and second straight lines.

2. The bulldozer according to claim 1, wherein the fuel tank and the cab are arranged such that a widthwise center of the fuel tank in the vehicle width direction is offset toward the first lateral side of the bulldozer in comparison to a widthwise center of the cab in the vehicle width direction; and the engaging part of the second engaging member is, in the rear view, positioned outward toward the second lateral side of the bulldozer with respect to a second lateral side of the fuel tank.

3. The bulldozer according to claim 1, wherein the first and second engaging members are plate-shaped members, each of the first and second engaging members having a first end portion and a second end portion with the first end portion being secured to the fuel tank and the second end portion having the engaging part, the second end portion of the first engaging member being disposed farther toward the first lateral side of the bulldozer than the first end portion of the first engaging member, and the second end portion of the second engaging member being disposed farther toward the second lateral side of the bulldozer than the first end portion of the second engaging member.

4. The bulldozer according to claim 1, wherein a rearward side of the fuel tank includes a tapered face that is tilted diagonally downward in a rearward direction, and the first and second engaging members are arranged on the fuel tank in positions forward of a longitudinal center of the fuel tank in a longitudinal direction of the bulldozer.

5. The bulldozer according to claim 1, wherein the first and second engaging members are detachably installed on the fuel tank.

6. The bulldozer according to claim 5, wherein a battery cover is arranged adjacent the fuel tank on the second lateral side of the bulldozer, and a storage structure for securing the first and second engaging members is provided inside a space covered by the battery cover.

7. The bulldozer according to claim 6, wherein first and second mounting parts for detachably installing the first and engaging members, respectively, are provided on the fuel tank, each of the first and second mounting parts including at least one hole for installing a bolt;

the storage structure includes at least one threaded hole configured to mesh with the bolt.

8. A bulldozer comprising:

a cab including a driver seat installed therein, and an air-conditioning cooling module projecting rearward from an upper end portion of the cab;

a fuel tank arranged rearward of the cab below the air-conditioning module, a widthwise dimension of the fuel tank being larger than a widthwise dimension of the air-conditioning module in a transverse direction of the bulldozer, no portion of the air-conditioning module extending beyond the fuel tank in the transverse direction of the bulldozer; and a first engaging member and a second engaging member provided on the fuel tank on opposite sides of a widthwise center of the fuel tank, each of the first and second engaging members being oblong members having a first end portion and a second end portion with the first end portion being secured to the fuel tank and the second end portion having an engaging part configured and arranged to engage with a suspension member for hoisting the fuel tank, the first and second engaging members extending diagonally upward and transversely outward from the fuel tank such that the second end portions are disposed farther from the widthwise center of the fuel tank than the first end portions.

9. The bulldozer according to claim 8, wherein in a rear view of the bulldozer, widthwise outermost edges of the air-conditioning module are disposed directly above a portion of the fuel tank that lies entirely between the first and second engaging members.

10. The bulldozer according to claim 8, wherein the first engaging member is provided on the fuel tank at a position adjacent a first lateral side of the fuel tank, and the second engaging member is provided on the fuel tank at a position adjacent a second lateral side of the fuel tank disposed opposite the first lateral side in the transverse direction of the bulldozer.

11. The bulldozer according to claim 10, wherein the engaging part of the first engaging member is positioned farther from the widthwise center of the fuel tank than an uppermost edge of the first lateral side of the fuel tank in a rear view of the bulldozer.

12. The bulldozer according to claim 10, wherein the engaging part of the second engaging member is positioned farther from the widthwise center of the fuel tank than an uppermost edge of the second lateral side of the fuel tank in a rear view of the bulldozer.

13. The bulldozer according to claim 11, wherein the engaging part of the second engaging member is positioned farther from the widthwise center of the fuel tank than an uppermost edge of the second lateral side of the fuel tank in a rear view of the bulldozer.

14. The bulldozer according to claim 8, wherein the fuel tank and the cab are arranged such that a widthwise center of the fuel tank in the vehicle width direction is offset toward the first lateral side of the bulldozer in comparison to a widthwise center of the cab in the vehicle width direction; and the engaging part of the second engaging member is, in the rear view, positioned outward toward the second lateral side of the bulldozer with respect to a second lateral side of the fuel tank.

15. The bulldozer according to claim 8, wherein a rearward side of the fuel tank includes a tapered face that is tilted diagonally downward in a rearward direction, and the first and second engaging members are arranged on the fuel tank in positions forward of a longitudinal center of the fuel tank in a longitudinal direction of the bulldozer.

16. The bulldozer according to claim 8, wherein the first and second engaging members are detachably installed on the fuel tank.

17. The bulldozer according to claim 16, wherein a battery cover is arranged adjacent the fuel tank on the second lateral side of the bulldozer, and a storage structure for securing the first and second engaging members is provided inside a space covered by the battery cover.

18. The bulldozer according to claim 17, wherein first and second mounting parts for detachably installing the first and engaging members, respectively, are provided on the fuel tank, each of the first and second mounting parts including at least one hole for installing a bolt;

the storage structure includes at least one threaded hole configured to mesh with the bolt.

* * * * *